US012660953B2

(12) United States Patent
Xie et al.

(10) Patent No.: US 12,660,953 B2
(45) Date of Patent: Jun. 23, 2026

(54) SQUEEZE PREVENTION BRACKET

(71) Applicant: Shenzhen Lute Jiacheng Supply Chain Management Co., Ltd., Shenzhen (CN)

(72) Inventors: Hong Xie, Shenzhen (CN); Kexin Fu, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 6 days.

(21) Appl. No.: 18/940,878

(22) Filed: Nov. 8, 2024

(65) Prior Publication Data

US 2025/0194833 A1 Jun. 19, 2025

(30) Foreign Application Priority Data

Dec. 15, 2023 (CN) ..... 202323445066.5

(51) Int. Cl.
*A47G 23/02* (2006.01)
*B65D 25/28* (2006.01)
*B65D 43/02* (2006.01)

(52) U.S. Cl.
CPC ..... *A47G 23/0216* (2013.01); *B65D 25/2811* (2013.01); *B65D 43/0202* (2013.01); *B65D 2543/00083* (2013.01)

(58) Field of Classification Search
CPC .. A47G 23/021; A47G 21/04; A47G 23/0216; B65D 47/0861; B65D 23/12; B65D 25/103; B65D 23/001
USPC ..... 220/705
See application file for complete search history.

(56) References Cited

U.S. PATENT DOCUMENTS 9,675,525 B2 * 6/2017 McBean ..... A61J 11/045

FOREIGN PATENT DOCUMENTS

CN 102341312 * 6/2015 ..... B65D 47/0861

* cited by examiner

*Primary Examiner* — Anthony D Stashick
*Assistant Examiner* — Raven Collins

(57) ABSTRACT

A squeeze prevention bracket is provided. The squeeze prevention bracket includes a side wall and a top wall; the side wall and the top wall are enclosed to form an accommodating space configured to accommodate a food packaging bag; a first opening and a second opening are provided in the top wall; the first opening is at least divided into a first section and a second section; the first section and the second section are arranged towards an edge region of the top wall along a middle region of the top wall in sequence; a width of the second section is greater than a width of the first section; the second section is configured to arrange a connection port of the food packaging bag in a penetrating manner and slide the connection port into the first section; the first section is configured to be clamped with the connection port.

9 Claims, 4 Drawing Sheets

SQUEEZE PREVENTION BRACKET

CROSS REFERENCE TO RELATED APPLICATIONS

The present application claims the benefit of Chinese Patent Application No. 202323445066.5 filed on Dec. 15, 2023, the contents of which are incorporated herein by reference in their entirety.

TECHNICAL FIELD

The present disclosure relates to the field of squeeze prevention for food, and particularly, to a squeeze prevention bracket.

BACKGROUND

Due to the immature self-control ability of an infant, the infant will squeeze a food containing device such as a complementary food bag when eating complementary food. As a result, the complementary food blows out from the food containing device such as the complementary food bag. However, it is troublesome to assemble and use a general squeeze prevention device. Furthermore, during assembling, a complementary food outlet of the food containing device such as the complementary food bag may be easily polluted. This has an adverse effect on dietary hygiene of the infant. Therefore, in response to the above problems, the present disclosure provides a squeeze prevention bracket.

SUMMARY

An objective of the present disclosure is to provide a squeeze prevention bracket which aims to solve the problems of squeeze prevention, troubles in assembling and use, and ease of pollution to a food containing device.

To achieve the above objective, the present disclosure provides a solution: A squeeze prevention bracket includes a side wall and a top wall; the side wall and the top wall are enclosed to form an accommodating space configured to accommodate a food packaging bag; a first opening and a second opening are provided in the top wall; the first opening is at least divided into a first section and a second section; the first section and the second section are arranged towards an edge region of the top wall along a middle region of the top wall in sequence; a width of the second section is greater than a width of the first section; the second section is configured to arrange a connection port of the food packaging bag in a penetrating manner and slide the connection port into the first section; the first section is configured to be clamped with the connection port; and the second opening is configured to arrange a straw in a penetrating manner.

In a specific implementation, the width of the second section gradually decreases in a direction from the second section to the first section.

In a specific implementation, an assembling slot is provided in the other end of the squeeze prevention bracket opposite to the top wall; and the assembling slot is configured to put the food packaging bag into the accommodating space.

In a specific implementation, an inner diameter of the squeeze prevention bracket gradually decreases in a direction from one end where the assembling slot is located to one end where the top wall is located.

In a specific implementation, an avoidance slot communicated with the first opening is further provided in the side wall; and the avoidance slot is configured to allow the connection port to be inserted laterally and slide into the first opening.

In a specific implementation, a width of the avoidance slot is greater than or equal to a width of the widest part of the second section.

In a specific implementation, the second opening is an elliptical hole.

In a specific implementation, the squeeze prevention bracket further includes a bottom cover; and the bottom cover is covered at the assembling slot.

In a specific implementation, one of the side wall and the bottom cover is provided with a clamping protrusion, and the other one of the side wall and the bottom cover is provided with a clamping groove; and the clamping protrusion is in clamping connection with the clamping groove.

In a specific implementation, supporting columns are arranged on the bottom cover; and the supporting columns press against the end, provided with the assembling slot, of the side wall.

Compared with the prior art, the squeeze prevention bracket provided by the present disclosure has the beneficial effects: The first opening is provided in the top wall. The first opening is divided into the first section and the second section. After a food containing device is assembled in the accommodating space, the connection port of the food containing device can pass through the second section and is then clamped into the second section, so that the connection port can be fixed on the first section. The second section can provide a larger pass-through space for the connection port of the food containing device in the process of passing through the first opening, which is convenient to fix the connection port of the food containing device at the first section of the first opening. Meanwhile, the second opening is further provided in the top wall, so that when a food outlet of the food containing device is located at an eccentric position, the food outlet of the food containing device can pass through the second opening, making the squeeze prevention bracket adapt to more types of food containing devices.

Figure 1:
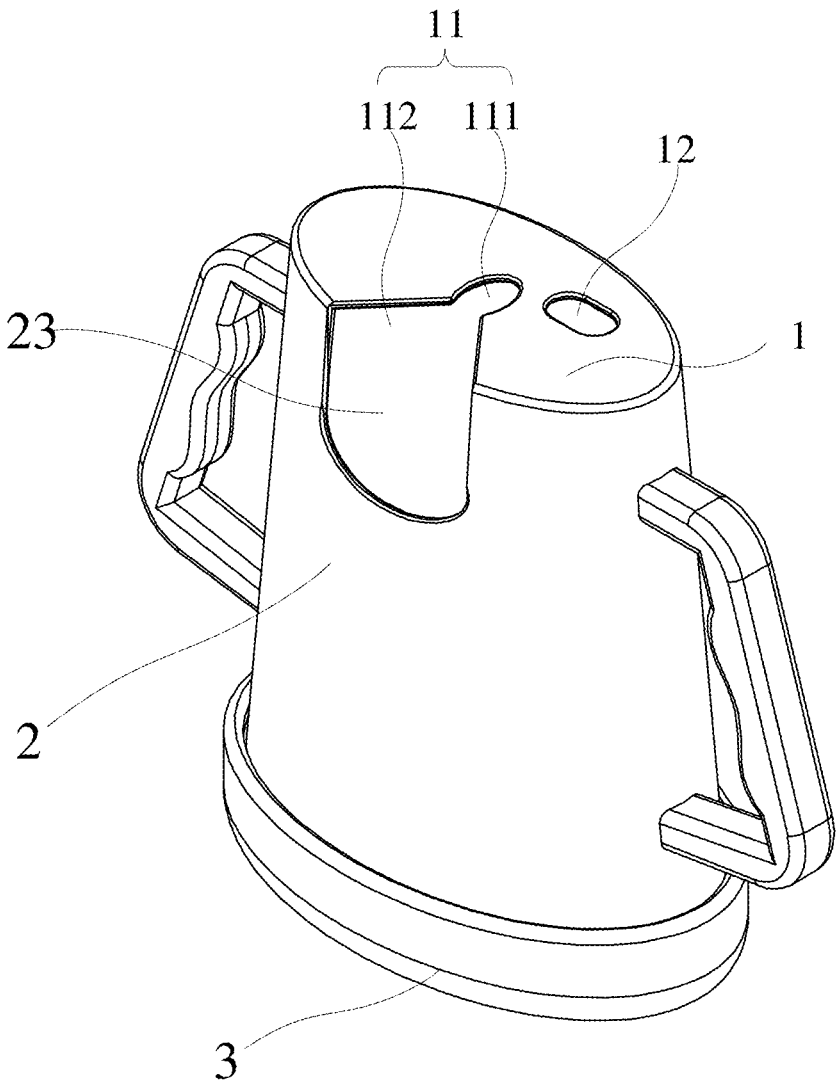
FIG. 1 is a schematic diagram of assembling of a squeeze prevention bracket provided by an embodiment of the present disclosure.

1: top wall; 11: first opening; 111: first section; 112: second section; 12: second opening; 2: side wall; 21: accommodating space; 22: assembling slot; 23: avoidance slot; 24: clamping protrusion; 3: bottom cover; 31: supporting column; and 32: clamping groove.

DETAILED DESCRIPTION OF THE EMBODIMENTS

In order to enable those skilled in the art to better understand the technical solutions of the present disclosure, a detailed description of the present disclosure is provided below in conjunction with the accompanying drawings. The description in this section is only exemplary and explanatory, and should not limit the scope of protection of the present disclosure in any way.

It should be noted that similar reference numerals and letters indicate similar items in the following drawings. Therefore, once a certain item is defined in one drawing, it is unnecessary to further define and explain it in the subsequent drawings.

It should be noted that orientations or positional relationships indicated by the terms "center", "upper", "lower", "left", "right", "vertical", "horizontal", "inner", "outer", and the like are orientations or positional relationships as shown in the drawings or orientations or positional relationships where this invention product is often located during use, and are only for the purpose of facilitating and simplifying the description of the present disclosure instead of indicating or implying that devices or elements indicated must have particular orientations, and be constructed and operated in the particular orientations, so that these terms are not construed as limiting the present disclosure. In addition, the terms "first", "second", "third", and the like are only for the purpose of description, and may not be understood as indicating or implying the relative importance.

In addition, the terms "horizontal", "vertical", "overhang" and the like do not mean that a component is required to be absolutely horizontal or suspended, but can slightly tilt. For example, "horizontal" only refers to a direction being more horizontal relative to "vertical", and it does not mean that the structure needs to be completely horizontal, but can slightly tilt.

Unless otherwise defined, all technical and scientific terms used herein have the same meaning as those commonly understood by a person skilled in the art to which the present disclosure belongs. Terms used in the specification of the present disclosure herein are merely intended to describe objectives of the specific embodiments, but are not intended to limit the present disclosure.

The present disclosure will be further explained in detail below in conjunction with the accompanying drawings.

The squeeze prevention bracket shown in FIG. 1 can prevent an infant from squeezing a food containing device during eating, causing food to blow out. Meanwhile, it can facilitate an operator to assemble the food containing device, and it is not easy to contaminate a food outlet of the food containing device during the assembling.

A squeeze prevention bracket includes a side wall 2 and a top wall 1. The side wall 2 and the top wall 1 are enclosed to form an accommodating space 21 configured to accommodate a food packaging bag. After a head and a tail of the side wall 2 are connected and enclosed, the top wall 1 seals one end of the side wall 2. The side wall 2 and the top wall 1 are enclosed to form the accommodating space 21. The accommodating space 21 is a space configured to place a food containing device. The food containing device can be bagged or boxed food. A first opening 11 and a second opening 12 are provided in the top wall 1. The first opening 11 is at least divided into a first section 111 and a second section 112; the first section 111 and the second section 112 are arranged towards an edge region of the top wall 1 along a middle region of the top wall 1 in sequence; a width of the second section 112 is greater than a width of the first section 111; the second section 112 is configured to arrange a connection port of the food packaging bag in a penetrating manner and slide the connection port into the first section 111; the first section 111 is configured to be clamped with the connection port; and the second opening 12 is configured to arrange a straw in a penetrating manner. The first opening 11 and the second opening 12 are gaps or holes provided in the top wall 1, from which a food outlet of the food containing device passes through.

In the present disclosure, after the food containing device is assembled into the accommodating space 21 of the squeeze prevention bracket, if the food outlet of the food containing device is located at a center position, the food outlet can pass through from the first opening 11. If the food outlet of the food containing device is located at an eccentric position, the food outlet can pass through from the second opening 12, so as to adapt to various food containing devices with the food outlets located at different positions. When the food containing device is a food bag, a food connection port is located at the center position. At this time, the connection port of the food bag can first pass through from the second section 112 of the first opening 11, and then the connection port can be clamped into the first section 111. In this way, the food connection port of the food bag can be fixed to the first section 111 of the first opening 11, and the food bag can be fixed inside the squeeze prevention bracket. Since a width of the second section 112 is greater than a width of the first section 111, it can be convenient for the connection port to pass through, and a guide effect can be achieved in the process of clamping the connection port into the first section 111, making it easier for an operator to assemble the food containing device.

The following will introduce the technical details of the various components one by one.

In some implementations, the width of the second section 112 gradually decreases in a direction from the second section 112 to the first section 111.

As shown in FIG. 1, during assembling of the food bag, due to a large diameter of the connection port of the food bag, a clamping groove for clamping and fixing is provided in the connection port, and the second section 112 is wider, it is more convenient for the food connection port to pass through from the second section 112 of the first opening 11. The second section 112 faces the first section 111. The width of the second section 112 gradually decreases, which can achieve the guide role in the process of clamping the food connection port into the first section 111. During assembling, the connection port of the food containing device can slide into the first section 111 along an edge of the second section 112, making it convenient for an operator to clamp and fix the food connection port onto the first section 111.

In some implementations, an assembling slot 22 is provided in the other end of the squeeze prevention bracket opposite to the top wall 1. The assembling slot 22 is configured to put the food packaging bag into the accommodating space 21. The assembling slot 22 is a port for assembling other components.

Figure 4:
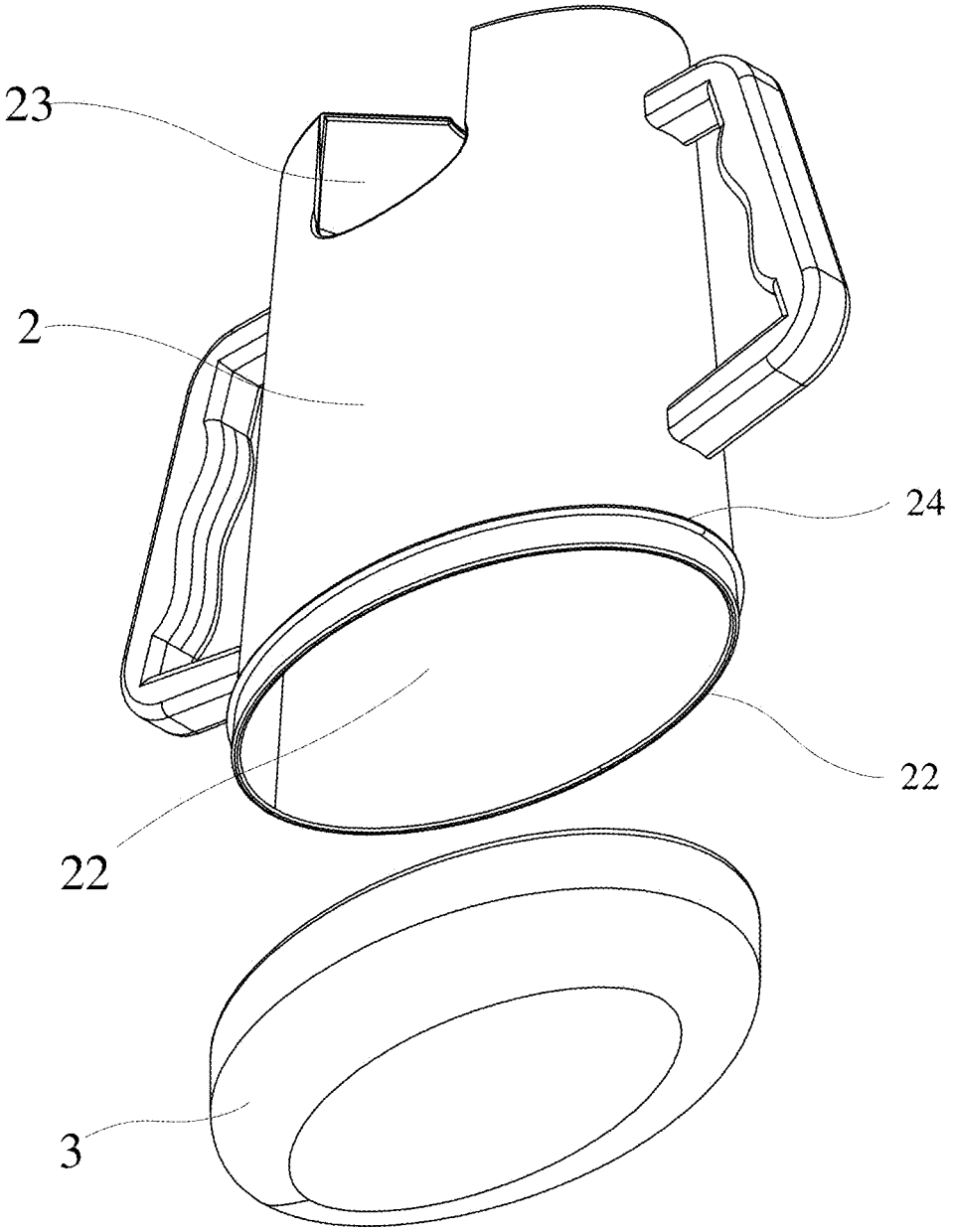
FIG. 4 is another schematic exploded diagram of a squeeze prevention bracket provided by an embodiment of the present disclosure.

As shown in FIG. 4, when the squeeze prevention bracket is used, the food containing device is assembled into the accommodating space 21 through the assembling slot 22.

In some implementations, an inner diameter of the squeeze prevention bracket gradually decreases in a direction from one end where the assembling slot 22 is located to one end where the top wall 1 is located.

Figure 2:
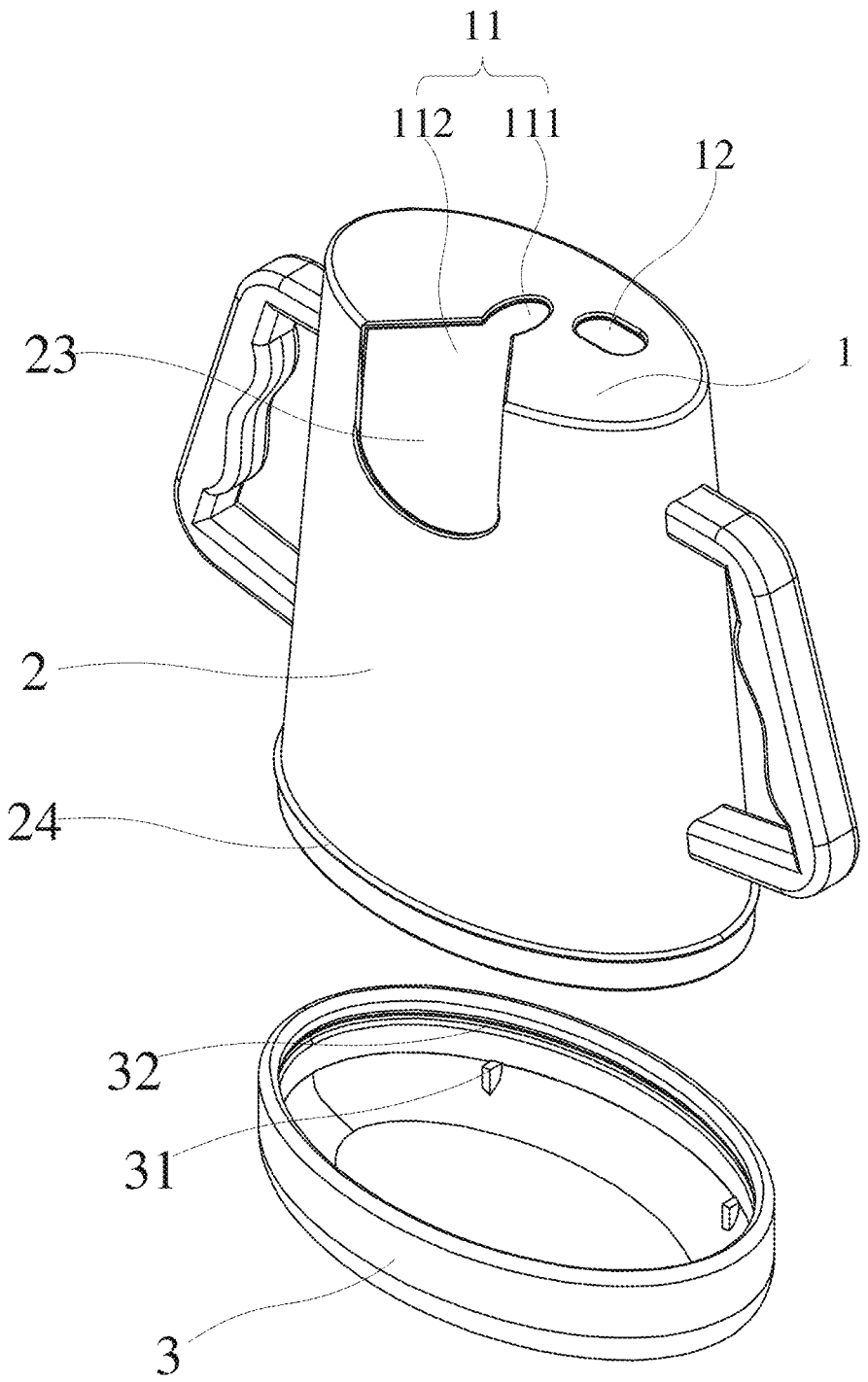
FIG. 2 is a schematic exploded diagram of a squeeze prevention bracket provided by an embodiment of the present disclosure.

As shown in FIG. 1 and FIG. 2, the food containing device is assembled into the accommodating space 21 through the assembling slot 22. The inner diameter of the squeeze prevention bracket gradually decreases from one section with the assembling slot 22 to the other end, making it more convenient to align the food containing device with the assembling slot 22. Meanwhile, when the squeeze prevention bracket is placed, the squeeze prevention bracket is more stably placed and does not easily tip over.

In some embodiments, an avoidance slot 23 communicated with the first opening 11 is further provided in the side wall 2; and the avoidance slot 23 is configured to allow the connection port to be inserted laterally and slide into the first opening 11. The avoidance slot 23 is a gap provided in a side portion and communicated with the first opening 11.

As shown in FIG. 1 and FIG. 2, during the assembling of the food containing device, the outlet of the food containing device needs to be aligned with the first opening 11 or the second opening 12 to ensure that the outlet of the food containing device accurately passes through from the first opening 11 or the second opening 12. In the alignment process, an operator needs to adjust the position of the outlet of the food containing device by inserting the fingers into the accommodating space 21. However, the first opening 11 and the second opening 12 are relatively narrow, which is inconvenient for the operator to insert the fingers. Therefore, the operator can adjust the position of the outlet of the food containing device by inserting the fingers into the accommodating space 21 through the avoidance slot 23, which provides a sufficient operation space for the operator and facilitates assembling.

In some implementations, a width of the avoidance slot 23 is greater than or equal to a width of the widest part of the second section 112.

As shown in FIG. 1 and FIG. 2, the avoidance slot 23 is communicated to the second section 112 of the first opening 11, which can provide a larger operation space for an operator. Meanwhile, when the food containing device is a food bag, the connection port of the food bag can also pass through from the avoidance slot 23, so that the assembling and fixing process of the food bag is more convenient and quicker.

In some implementations, the second opening 12 is an elliptical hole.

As shown in FIG. 1, the second opening 12 is elliptical, which can adapt to more types of straws of different specifications, thereby improving the adaptability of the squeeze prevention bracket.

In some implementations, the squeeze prevention bracket further includes a bottom cover 3. The bottom cover 3 is covered at the assembling slot 22. The bottom cover 3 is a component that is covered at the assembling slot 22 in the side wall 2 to support the food containing device.

As shown in FIG. 1, FIG. 2, and FIG. 4, when the food containing device cannot be fixed on the top wall 1, the food containing device will be separated from the accommodating space 21 after being assembled into the accommodating space 21. The bottom cover 3 can support the food containing device after being covered at the assembling slot 22 of the side wall 2, to prevent the food containing device from being separated from the accommodating space 21, thereby facilitating the use of squeeze prevention bracket.

In some embodiments, one of the side wall 2 and the bottom cover 3 is provided with a clamping protrusion 24, and the other one of the side wall 2 and the bottom cover 3 is provided with a clamping groove 32; and the clamping protrusion 24 is in clamping connection with the clamping groove 32. The clamping protrusion 24 is an annular protrusion structure arranged on the side wall 2 or the bottom cover 3 to connect them, and the clamping groove 32 is a structure arranged on the bottom cover 3 or the side wall 2 and cooperating with the clamping protrusion 24 to connect the bottom cover 3 with the side wall 2.

As shown in FIG. 2, the clamping protrusion 24 is arranged on the side wall 2, and the clamping groove 32 is provided in the bottom cover 3. Of course, the clamping protrusion 24 can also be arranged on the bottom cover 3, and the clamping groove 32 can be provided in the side wall 2. During use of the squeeze prevention bracket, the bottom cover 3 and the side wall 2 need to be frequently assembled and disassembled. The assembling and disassembling process can be simple and quick through the clamping connection between the clamping protrusion 24 and the clamping groove 32, which facilitates the use of the squeeze prevention bracket.

In some implementations, supporting columns 31 are arranged on the bottom cover 3, and the supporting columns 31 press against the end, provided with the assembling slot 22, of the side wall 2. The supporting columns 31 are cylindrical protrusion structures on one side of the bottom cover 3 close to the assembling slot 22 of the side wall 2. The supporting columns play a role in preventing the bottom cover and the side wall from being excessively clamped during the assembling of the bottom cover 3 and the end, provided with the assembling slot 22, of the side wall 2. Excessive clamping means that the clamping protrusion 24 moves the side of the clamping groove 32 away from the side wall 2 due to an excessive external force, resulting in the clamping protrusion 24 not being clamped with the clamping groove 32.

Figure 3:
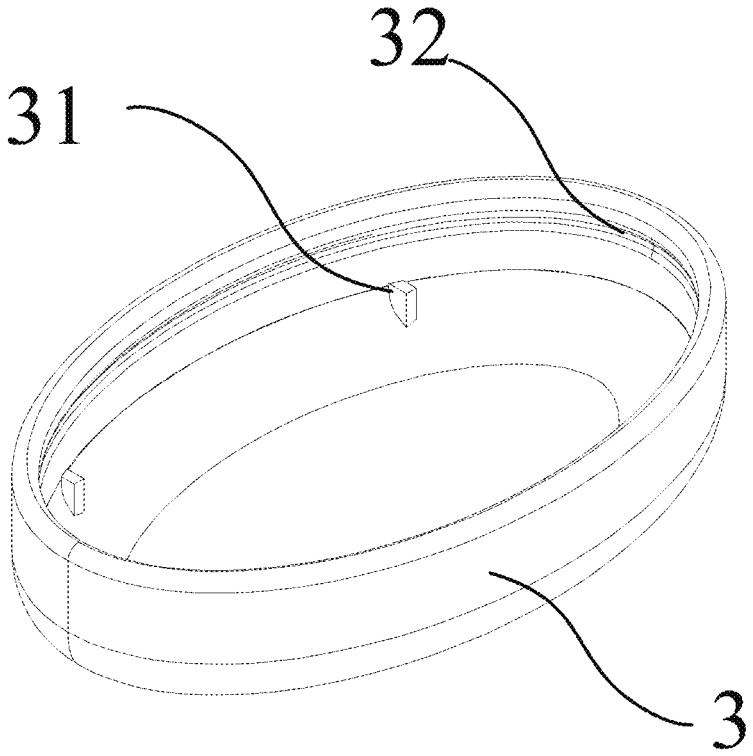
FIG. 3 is a schematic structural diagram of a bottom cover provided by an embodiment of the present disclosure.

As shown in FIG. 2 and FIG. 3, due to a smooth curved surface at a transition junction between a side surface of the bottom cover 3 and a bottom surface of the bottom cover 3, an excessive force during the clamping will lead to excessive clamping. Excessive clamping means that the clamping protrusion 24 moves the side of the clamping groove 32 away from the side wall 2 due to an excessive external force, resulting in the clamping protrusion 24 not being clamped with the clamping groove 32. In order to prevent the occurrence of the excessive clamping, the supporting columns 31 can press against the end, provided with the assembling slot 22, of the side wall 2 when the bottom cover 3 is clamped with the end, provided with the assembling slot 22, of the side wall 2, thereby limiting the movement of one end of the assembling slot 22 of the side wall 2 during the clamping, preventing the occurrence of excessive clamping, and facilitating the normal use of the squeeze prevention bracket.

In the description of the present disclosure, it should be noted that unless otherwise specified and limited, the terms "arrange", "mount", "connect", and "connection" should be broadly understood. For example, it can be a fixed connection, detachable connection, integrated connection, mechanical connection, electrical connection, direct connection, indirect connection via an intermediate element, or internal communication between two elements. For those of ordinary skill in the art, the specific meanings of the aforementioned terms in the present disclosure can be understood based on specific conditions.

It should be noted that in this document, relationship terms such as first and second are used solely to distinguish one entity or operation from another entity or operation without necessarily requiring or implying any actual such relationship or order between such entities or operations. Furthermore, the terms "include", "including", or any other variation thereof, are intended to encompass a non-exclusive inclusion, such that a process, method, article, or device that includes a list of elements does not include only those elements but may include other elements not explicitly listed or inherent to such process, method, article, or device.

Without more constraints, an element limited by "includes a . . . " does not preclude the existence of additional identical elements in the process, method, product, or device that includes the element.

Although the embodiments of the present disclosure have been shown and described, it can be understood by those of ordinary skill in the art that various changes, modifications, substitutions, and variations can be made to these embodiments without departing from the principle and spirit of the present disclosure. The scope of the present disclosure is defined by the accompanying claims and their equivalents.

What is claimed is:

1. A squeeze prevention bracket, comprising a side wall and a top wall, wherein the side wall and the top wall are enclosed to form an accommodating space configured to accommodate a food packaging bag; a first opening and a second opening are provided in the top wall; the first opening is at least divided into a first section and a second section; the first section and the second section are arranged towards an edge region of the top wall along a middle region of the top wall in sequence; a width of the second section is greater than a width of the first section; the second section is configured to arrange a connection port of the food packaging bag in a penetrating manner and slide the connection port into the first section; the first section is configured to be clamped with the connection port; wherein an assembling slot is provided in the other end of the squeeze prevention bracket opposite to the top wall; and the assembling slot is configured to put the food packaging bag into the accommodating space; wherein the squeeze prevention bracket further comprises a bottom cover; and the bottom cover is covered at the assembling slot; wherein supporting columns are arranged on the bottom cover; and the supporting columns press against the end, provided with the assembling slot, of the side wall.

2. The squeeze prevention bracket according to claim 1, wherein the width of the second section gradually decreases in a direction from the second section to the first section.

3. The squeeze prevention bracket according to claim 1, wherein an inner diameter of the squeeze prevention bracket gradually decreases in a direction from one end where the assembling slot is located to one end where the top wall is located.

4. The squeeze prevention bracket according to claim 1, wherein an avoidance slot communicated with the first opening is further provided in the side wall; and the avoidance slot is configured to allow the connection port to be inserted laterally and slide into the first opening.

5. The squeeze prevention bracket according to claim 4, wherein a width of the avoidance slot is greater than or equal to a width of the widest part of the second section.

6. The squeeze prevention bracket according to claim 1, wherein the second opening is an elliptical hole.

7. The squeeze prevention bracket according to claim 1, wherein one of the side wall and the bottom cover is provided with a clamping protrusion, and the other one of the side wall and the bottom cover is provided with a clamping groove; and the clamping protrusion is in clamping connection with the clamping groove.

8. A squeeze prevention bracket, comprising: a side wall and a top wall, wherein the side wall and the top wall are enclosed to form an accommodating space configured to accommodate a food packaging bag; a first opening provided in the top wall; wherein the first opening is at least divided into a first section and a second section; the first section and the second section are arranged towards an edge region of the top wall along a middle region of the top wall in sequence; a width of the second section is greater than a width of the first section; the second section is configured to arrange a connection port of the food packaging bag in a penetrating manner and slide the connection port into the first section; the first section is configured to be clamped with the connection port; an assembling slot provided in an end of the squeeze prevention bracket opposite to the top wall, wherein the assembling slot is configured to allow insertion of the food packaging bag into the accommodating space; a bottom cover covered at the assembling slot; and supporting columns arranged on the bottom cover; wherein the supporting columns press against an end of the side wall provided with the assembling slot.

9. The squeeze prevention bracket according to claim 8, wherein one of the side wall and the bottom cover is provided with a clamping protrusion, and the other one of the side wall and the bottom cover is provided with a clamping groove; and the clamping protrusion is in clamping connection with the clamping groove.

* * * * *